US006634158B1

(12) United States Patent
Bois

(10) Patent No.: US 6,634,158 B1
(45) **Date of Patent: *Oct. 21, 2003**

(54) FORM FILL AND SEAL PACKAGING MACHINE WITH REPLACEABLE FORMING NECK

(75) Inventor: Henri Georges Bois, Neuilly sur Seine (FR)

(73) Assignee: Flexico-France (FR)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/207,552

(22) Filed: Dec. 8, 1998

(30) Foreign Application Priority Data

Dec. 9, 1997 (FR) ..... 97 15539

(51) Int. Cl.[7] ..... B65B 9/06
(52) U.S. Cl. ..... 53/551; 53/574
(58) Field of Search ..... 53/551, 574, 133.4, 53/139.2; 493/213, 927

(56) References Cited

U.S. PATENT DOCUMENTS 4,617,683 A * 10/1986 Christoff ..... 53/551
4,655,862 A * 4/1987 Christoff et al. ..... 493/927
4,709,398 A * 11/1987 Ausnit ..... 493/214
4,878,987 A * 11/1989 Ven Erden ..... 493/213
4,894,975 A * 1/1990 Ausnit ..... 53/551
4,909,017 A * 3/1990 McMahon et al. ..... 53/551
5,067,306 A * 11/1991 Umezawa ..... 53/551
5,111,643 A * 5/1992 Hobock ..... 53/139.2
5,412,924 A * 5/1995 Ausnit ..... 53/551
5,755,082 A * 5/1998 Takahashi et al. ..... 53/551
5,816,018 A * 10/1998 Bois ..... 53/133.4

* cited by examiner

*Primary Examiner*—Lesley D. Morris
*Assistant Examiner*—Matthew Luby
(74) *Attorney, Agent, or Firm*—Pitney, Hardin, Kipp & Szuch LLP

(57) ABSTRACT

A machine for forming reclosable packaging includes a removable forming neck which can be replaced with different forming necks of various diameters. The machine has a mechanism (40) for attaching closure strips (P) onto a film that have lengths up to half the circumference of the smallest forming neck (10), and a mechanism (60)" that makes the transverse welds (61, 62) along a length equal to at least equal half the circumference of the largest forming neck (10).

10 Claims, 3 Drawing Sheets

FORM FILL AND SEAL PACKAGING MACHINE WITH REPLACEABLE FORMING NECK

Background of the Invention

The present invention relates to the field of bags or packages containing complementary closure strips for allowing successive opening and closing.

More particularly, the present invention concerns the field of machines for automatically forming, filling, and closing such packaging formed of thermoplastic film and including complimentary male and female closure strips. Machinery of this kind is often referred to as FFS machinery.

Many machines of this type have already been proposed (see, for example EP-A-528721 and U.S. Pat. No. 4,894,975. As shown in FIG. 1, most of these machines include a forming neck (10), which receives incoming film (F) in a flat state as it is supplied by an unrolling mechanism (20) and outputs the film (F) formed into a tube; a filling spout (30) extending into said forming neck (10) and, hence, into said tube; a mechanism (40) for positioning closure strips (P) and attaching them to the film (F); a mechanism (50) for longitudinal sealing the tube closed; and a mechanism (60) suitable for sequentially forming a first transverse weld (61) before introduction of a product into the tube through the filling spout (30) and a second transverse weld (62) after the product has been introduced into the tube, to form a package around the product.

Most of the machines proposed so far are designed to receive the closure strips (P) in the longitudinal direction, that is, parallel to the direction in which the film (F) moves. However, machines with longitudinal strips have the disadvantage of limiting the height of bags that can be obtained. This height is, in fact, equal to half the circumference of the forming neck. Moreover, the packages obtained on these machines sometimes have defects in sealing. This is due to the fact that the mechanism for transverse sealing (60) must operate through the excessive thickness formed by the longitudinal profiles (P).

Attempts to remedy this situation have been made by not placing the closure strips (P) longitudinally, i.e. in the direction of the film movement, but rather placing the strips transversely, that is, perpendicular to the direction of movement of the film (F).

Early attempts are described in U.S. Pat. No. 4,617,683 and 4,655,862. These patents, which issued more than a decade ago, offered two solutions for positioning closure strips (P) transversely onto the film (F) in a flat state, before the film arrives at the forming neck (10).

The attempts proposed were initially considered promising. Ultimately, however, they failed to provide satisfactory results and were rejected. In particular, it was observed that the mechanisms described in the patents did not always allow the transverse ,strips to be placed completely straight across the film. As a result, it was often difficult for the complementary sections to be fitted together.

Other solutions were subsequently proposed in an attempt to overcome the inconveniences resulting from utilizing the mechanisms described in the cited patents. In U.S. Pat. Nos. 4,666,536, 4,701,361, 4,878,987, 4,617,683, 4,655,862, 4,844,759, 5,111,643, 4,709,398, and 4,909,017, for example, other mechanisms intended to place transverse closure strips on a film have been proposed.

In the applicant's own patent application FR-A-2 745 261, a machine for forming packages from film is described that includes a mechanism for placing closure strips transversely onto a film, the strips being formed in combination with a straight guide that has been placed transversely on it and designed to allow positioning a closure strip precisely across the film, and a mechanism for gripping the upstream end of the closure strip and moving transversely along the guide, to guide the closure strip into the latter by traction on the upstream end of the closure.

To date, none of these attempts have met with manufacturing success as far as known by the inventor hereof. This disaffection on the part of manufacturers with machines using transverse strips appears to be particularly attributable to the fact that, although these machines allow a certain degree of latitude in defining the height of bags, it is also true that these machines in principle require bags with a constant width, equal to half the circumference of the forming neck.

The principle object of the present invention is to provide an improved machine for forming packages of film including complementary closure strips placed transversely on the film that allows unrestricted variation of the width of the bags obtained.

According to the present invention, this objective is achieved by means of a machine characterized by the fact that it includes a removable forming neck, so that the user can install a variety of forming necks of different diameters and a mechanism for attaching closure strips having a length of up to half the circumference of the largest forming neck.

The present invention further relates to a process for forming packages and the closure means for this purpose.

Brief Description of the Drawings

Other characteristics, objectives, and advantages of the present invention will appear from reading the following detailed description in connection with the attached drawings which are provided as examples and in which.

Detailed Description of the Preferred Embodiments

Figure 1:
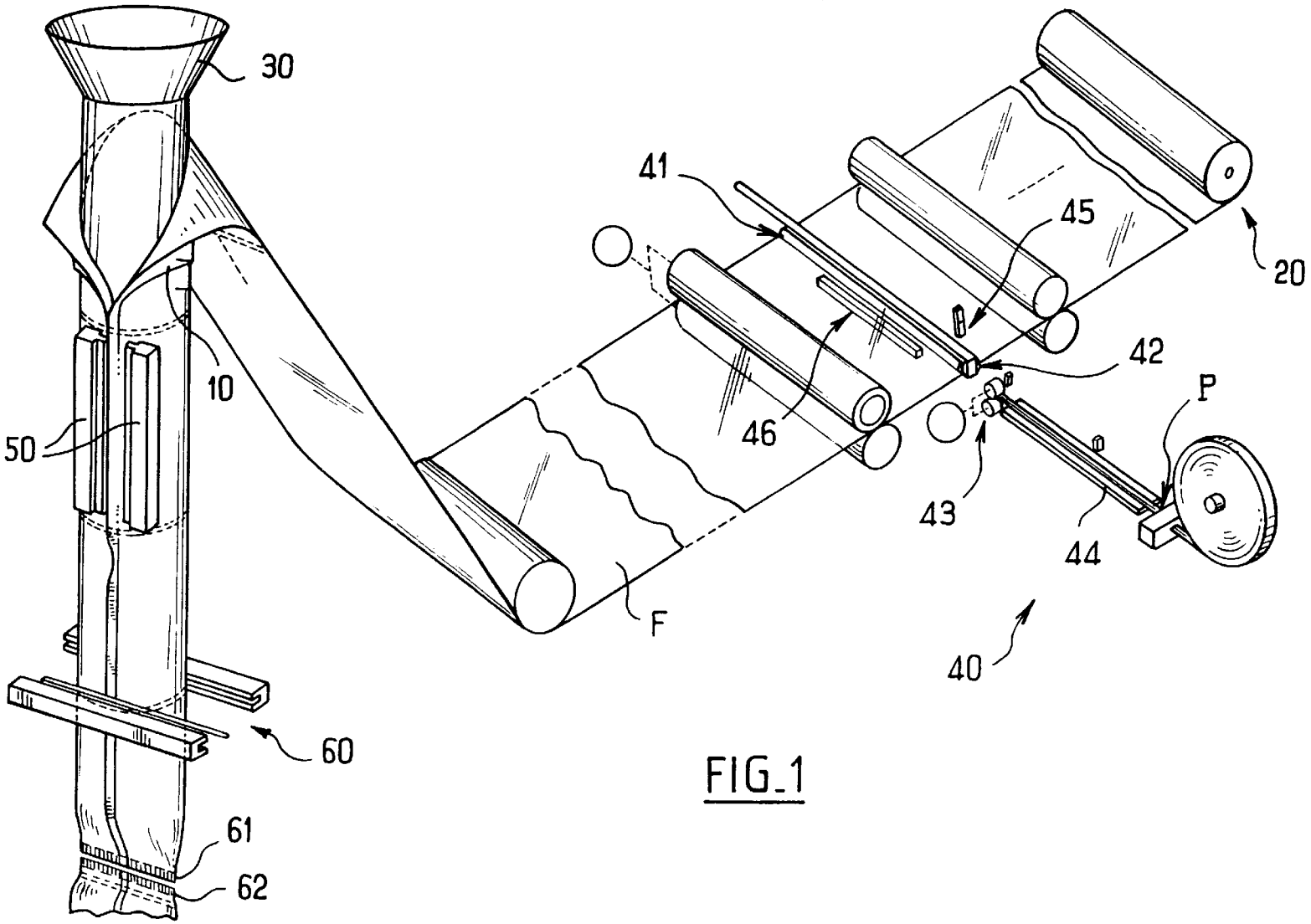
FIG. 1 is a schematic perspective view of a general structure of an automatic forming, filling, and sealing machine for bags.

The general structure of a machine according to the present invention, designed to provide automatic forming, filling, and sealing of bags or packages with complementary closure strips extending transversely on the film, is conventional per se and consistent with the mechanisms described previously in connection with FIG. 1. For this reason, the structure of the machine will not be described below in great detail.

In terms of its general structure, the machine includes: a forming neck (10), which receives incoming film (F) in a flat state from an unrolling mechanism (20) and outputs the film (F) shaped into a tube; a filling spout (30) extending into the forming neck (10) and consequently into said tube; a mechanism (40) for positioning closure strips (P) and for attaching them transversely onto the film (F) before it arrives at the forming neck (10); a mechanism (50) for providing a longitudinal seal in order to close the tube longitudinally; and a mechanism (60) suitable for generating sequentially a first transverse seal (61) before a product is introduced into the tube through the filling spout (30) and then another transverse seal (62) after the product is introduced into the tube.

According to the present invention, a removable forming neck 10 is provided which may be removed and replaced on the same machine with a forming neck having a different diameter.

Of course the width of the film F must be consistent with the diameter of the forming neck selected. That is, it must be equal to the circumference of the forming neck plus the necessary film width for allowing longitudinal sealing of the edges of the film by means of mechanism 50.

In addition, within the context of the present invention, the mechanism (40) for attaching closure strips (P) must be suitable for attaching portions of closure strips (P) upon the film that have a length at most half the circumference of the forming neck (10).

Moreover, the mechanism (60) for making the transverse seals (61) and (62) must be suitable for assuring a package-closing connection along a length which is at least equal to half the circumference of the widest forming neck (10).

Numerous variants are possible for the mechanism (40) for transverse positioning and attachment of closure strips (P) onto the film (F) before it arrives at the forming neck (10).

This positioning and attaching mechanism (40) is preferably consistent with the description in document FR-A-2 745 261 which is incorporated herein by reference.

More specifically in this context, this positioning mechanism (40) preferably includes:

- at least one straight guide (41), placed on the film (F) transversely to the direction in which it moves, upstream from the forming neck (10); and
- a mechanism (42) for gripping the upstream end of the closure (P), this gripping mechanism (42) being capable of moving transversely crosswise across the guide (41) to position the closure strip (P) onto it by traction on the upstream end of the closing device (P).

Various embodiments are possible for the gripping mechanism (42).

Preferably, the gripping mechanism is formed from a controlled set of clamps which, when shut, grip the upstream end of a segment of strip (P), in order to position it on the straight guide (41), then open so as to release the strip segment (P) before returning to its initial position for gripping another segment.

According to one embodiment, this gripping mechanism (42) can consist of a suction head.

Of course, it is preferable that the transversely moving components of the gripping mechanism (42) be synchronized with the longitudinal movement of the film (F).

In addition, it is advantageous for closure strips (P) to be consistent with features described and shown in a patent application filed by the applicant in France on Nov. 6, 1997, under number 97 13944, which corresponds to U.S. application number 09/187,103, filed on Nov. 5, 1998. Thus the closing device (P) preferably includes two generally parallel supporting prolongations situated on the inner surfaces in a recessed position with respect to the lateral edges, so that at least one is situated opposite to at least one longitudinal set consisting of two complementary strips, male and female for example, attached respectively to the two supporting prolongations, and another longitudinal set (also consisting, for example, of two complementary strips attached respectively to said elements, or even a simple rib or groove shaped so as to extend lengthwise along the inner surface of at least one of said prolongations) situated at a distance from the first set, along the width of the supporting prolongation.

Furthermore, in this context and as described and shown in patent application FR 97 13944, the positioning mechanism (40) includes a mechanism for pulling supporting prolongations together and apart between the two longitudinal sets, so that the distance separating the lateral edges of the two supporting prolongations increases under the effect of this pulling stress, by deformation of the prolongations.

It is possible for the pulling components to be temporary and to consist of rollers or a clamp, the two jaws of which are capable of pulling the prolongations together and apart between the two longitudinal sets.

According to another variant, which can be used in combination with the temporary pulling mechanism mentioned previously, it is also possible to provide a permanent pulling mechanism at the axial end of the prolongations, between the two sets, in the form of a seal.

A seal of this type is realized before the segments of the closing device (P) are positioned onto the film (F).

Auxiliary mechanisms are preferably provided for positioning closure strips (P): drive rollers (43), a guide (44), upstream from the film (F) for cutting the strip segments (P).

The closure strips (P) are attached to the film (F) by any appropriate means, although it is advantageous for sealing clamps to be used in conjunction with the straight guide (41), as represented schematically by reference number 46 in Figure More specifically, it is preferable for one of the supporting prolongations for segments of the closure strips (P) to be sealed onto the film (F) upstream from the forming neck, by means of transverse sealing clamps (60) immediately below (F), in order to grip the film and the prolongation of the closure strip against the guide (41), which thus serves as a supporting block during the sealing step.

The other supporting prolongation on the closing device (P) is attached to the inner wall of the package while it is being finished, after it has been filled and downstream from the forming neck. In this case, the second prolongation can be sealed onto the film (F) by means of transverse sealing clamps (60), or else by means of specific additional transverse sealing clamps.

Multiple variants are possible for the transverse seal (62) realized by mechanism 60 or mechanisms associated with them.

The seal is preferably designed so as to ensure sealing of the packages between the closure strips (P) and the lateral edges of the package.

Figure 2:
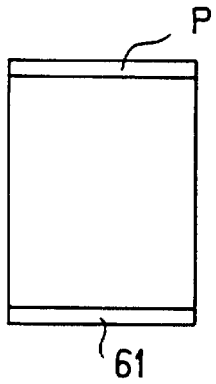
FIGS. 2 and 3 are schematic illustrations of two embodiments of packages with different widths that can be obtained on a single machine in accordance with the present invention.
Figure 3:
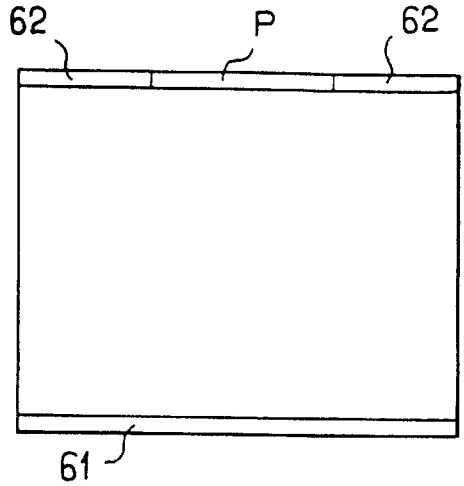
Prior Art FIG 3

As shown in FIGS. 2 and 3, the seal (62) can be straight and transverse with respect to the direction in which the film (F) moves.

Hence, FIG. 2 shows a package in which the length of closing sections (P) coincides with the width of the package, and FIG. 3 shows a packet where the length of the closure strips (P) is clearly less than the width of the package, with sealing between the ends of the closure strips (P) and the lateral edges of the package being assured by the seal (62).

It should be noted that the packages illustrated in FIGS. 2 and 3 have different heights or depths. These can be adjusted by modifying the operating interval of the transverse sealing mechanism (60).

Nevertheless, it is preferable for the seals not to be straight, but curved, for example, convex toward the interior of the package, as shown schematically in FIGS. 4 through 10.

Figure 4:
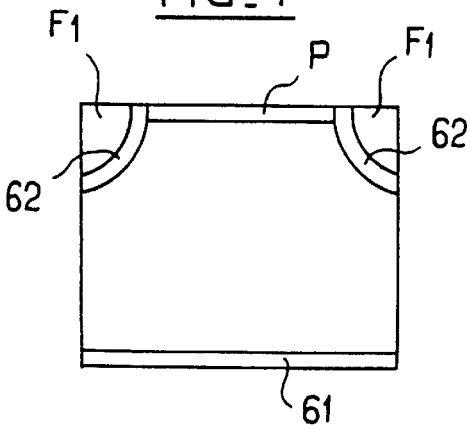
FIGS. 4 and 5 are schematic illustrations of two other embodiments of packages with different widths that can be obtained on another single machine in accordance with the present invention.
Figure 5:
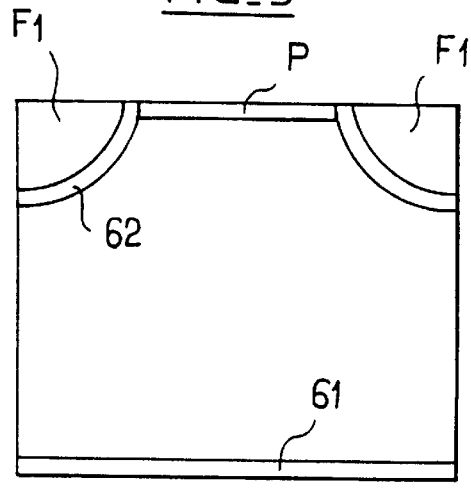

As shown in FIGS. 4 and 5, the transverse seals (62) can thus be curved, with a continuous curvature.

Figure 6:
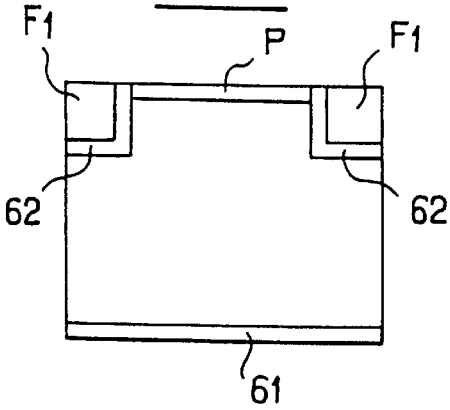
FIGS. 6 and 7 are schematic illustrations of two additional embodiments of packages with different widths that can be obtained on yet another single machine in accordance with the present invention.
Figure 7:
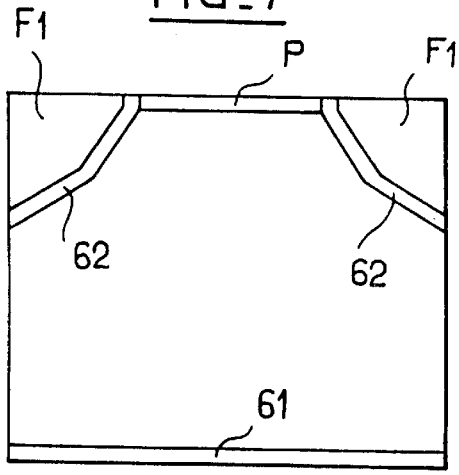

They can also be formed from various straight segments to slant in relation to one another, as indicated in FIG. 6 (where different segments comprising the seal (62) are perpendicular to one another) and FIG. 7 (where different segments comprising the weld (62) slant at an obtuse angle).

These arrangements are especially advantageous for applications involving liquid contents. Indeed, the shape of the mouth of a packet produced in this manner allows its contents to flow out easily.

It should be noted that according to the embodiments illustrated in FIGS. 4 through 7, the seals (62) converge toward the bottom of the packet (in other words, toward the first transverse seal (61)), in the direction of its lateral edges. Accordingly, sections (F1) that do not perform any function are formed on the outer portions of segments of the seal (62).

Figure 8:
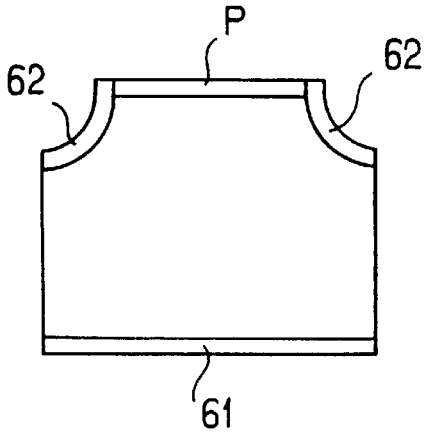
FIGS. 8, 9, and 10 represent three alternative embodiments of packages in accordance with the present invention.
Figure 9:
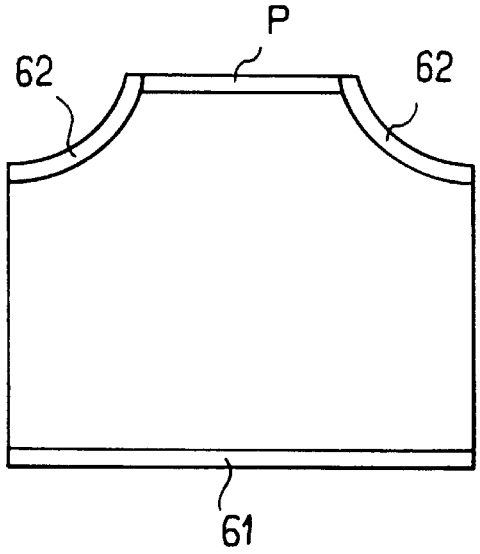

It is possible for these sections (F1) to be removed, as illustrated in FIGS. 8 and 9, for example by means of the cutting mechanisms associated with the sealing mechanism (60), which are also suitable for separating the various packages that have been made from one another.

According to the embodiments shown in FIGS. 2 through 9, the closure strips (P) are centered on the packages.

Figure 10:
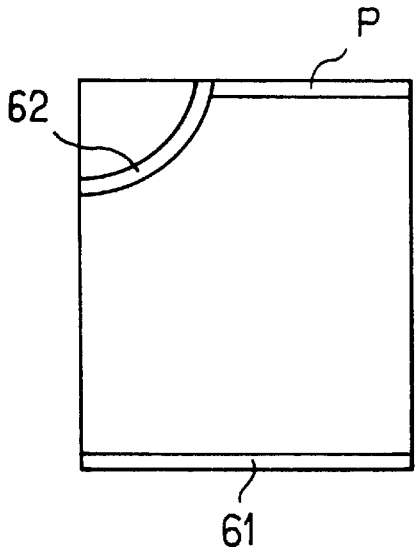

According to another embodiment, as illustrated in FIG. 10, it is possible to place the closure strips off center, for example by placing these closure strips (P) adjacent to one of the lateral edges of the package.

There can be multiple variants for the film (F) to be used. It can consist of a flexible film composed of a single-layer or multi-layer plastic material, which can be coated in appropriate instances, for example with metal.

Those familiar with the art will understand that the present invention offers numerous advantages in comparison with previously existing systems, especially insofar as it allows the production of packages with a large variety of widths and/or depths to be provided by means of the same basic machine.

Of course, the present invention is not limited to the specific embodiments that have just been described, but it encompasses any variants that are consistent with its fundamental concepts.

Accordingly, the application of the invention to automatic Form, Fill, and Seal machines for packaging from film has been described above.

It is possible, however, as a variant, for filling of the packages to occur during a subsequent and separate operation, after the packages have been formed.

Moreover, the present invention can be applied not only in machines of a vertical type for forming packages, as shown in the attached diagrams, but likewise in relation to machines of a horizontal type.

According to yet another variant, in the context of the present invention, closing devices (P) can be placed obliquely onto the film (F) with respect to the direction in which it moves.

Having thus described the invention, what is claimed is:

1. A machine for forming packages from plastic film, said machine including:

a forming neck capable of receiving flat film and forming said film into a tube corresponding to a cylindrical portion of said forming neck with said forming neck being removably mounted to said machine and being interchangeable with a plurality of forming necks having cylindrical portions of different diameters;

means for attaching closure strips to said film, said attaching means being disposed upstream of said forming neck, said closure strip attaching means being of a sufficient length to attach closure strips having a length of up to half the circumference of a largest cylindrical portion of said forming neck;

means for joining the longitudinal edges of said flat film;

and means for transversely sealing said tube to form a package having a front, back and sides, said transverse sealing means producing a weld along a length equal to at least half the circumference of the largest cylindrical portion of said forming neck to weld said closure strips to said package front and back and to weld said package front to said package back from respective ends of said closure strips to respective package sides; thereby forming a seal between said closure strips respective ends and said package sides.

2. The machine in accordance with claim 1 further comprising a filling spout opening into said forming neck.

3. The machine in accordance with claim 1 wherein said closure strip attaching means attaches said closure strips along a generally straight line transverse to a longitudinal direction of movement of said film over the forming neck.

4. The machine in accordance with claim 1, wherein said transversely sealing means forms a seal along a curved path between said respective closure strip ends and package sides.

5. The machine in accordance with claim 4 wherein said curved path is generally convex to the interior of a package.

6. The machine in accordance with claim 1, wherein said transversely sealing means forms seals in a series of straight segments that are slanted with respect to one another between said respective closure strip ends and package sides.

7. The machine in accordance with claim 1, wherein said machine further comprises means for removing sections of said package extending above said closure strips and said transverse seal and between a succeeding package formed by said machine.

8. The machine in accordance with claim 1 wherein said closure strip attaching means attaches said closure strips transversely centered on said film.

9. The machine in accordance with claim 1 wherein said closure strip attaching means attaches said closure strips transversely off-center on said film and adjacent to a lateral edge of said film.

10. The machine in accordance with claim 1, wherein said transversely sealing means forms seals obliquely with respect to a longitudinal movement of said film between said respective closure strip ends and package sides.

* * * * *